US009738838B2

(12) United States Patent
Zhan et al.

(10) Patent No.: US 9,738,838 B2
(45) Date of Patent: Aug. 22, 2017

(54) HYDROPROCESSING OF HYDROCARBONS USING DELAMINATED ZEOLITE SUPPORTS AS CATALYSTS

(71) Applicant: Chevron U.S.A. Inc., San Ramon, CA (US)

(72) Inventors: Bi-Zeng Zhan, Albany, CA (US); Stacey Ian Zones, San Francisco, CA (US); Christopher M. Lew, Richmond, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 14/919,545

(22) Filed: Oct. 21, 2015

(65) Prior Publication Data

US 2016/0115396 A1 Apr. 28, 2016

Related U.S. Application Data

(63) Continuation-in-part of application No. 14/521,098, filed on Oct. 22, 2014.

(51) Int. Cl.

| | |
|---|---|
| ***C10G 45/64*** | (2006.01) |
| ***C10G 47/20*** | (2006.01) |
| ***C10G 47/18*** | (2006.01) |
| ***C10G 47/16*** | (2006.01) |
| ***C10G 45/62*** | (2006.01) |

(52) U.S. Cl.

CPC ..... *C10G 45/64* (2013.01); *C10G 45/62* (2013.01); *C10G 47/18* (2013.01); *C10G 47/20* (2013.01); *C10G 2300/1022* (2013.01)

(58) Field of Classification Search

CPC ..... C10G 47/20; C10G 47/18; C07C 5/2775; C07C 2529/74

See application file for complete search history.

(56) References Cited

U.S. PATENT DOCUMENTS

| | | | | |
|---|---|---|---|---|
| 2,676,907 A * | 4/1954 | Oblad | B01J 23/28 | 208/110 |
| 4,910,006 A * | 3/1990 | Zones | B01J 29/04 | 423/326 |
| 4,921,495 A | 5/1990 | Kira | | |
| 4,921,594 A * | 5/1990 | Miller | B01J 29/85 | 208/111.15 |

(Continued)

OTHER PUBLICATIONS

Shell (http://www.shell.com/business-customers/global-solutions/refinery-technology-licensing/catalytic-dewaxing.html).*

(Continued)

*Primary Examiner* — In Suk Bullock
*Assistant Examiner* — Jason Chong
(74) *Attorney, Agent, or Firm* — E. Joseph Gess; Melissa M. Hayworth; Mark L. Warzel

(57) ABSTRACT

Provided is an improved hydroprocessing process allowing one to realize superior isoselectivity. The process comprises contacting a feed comprised of normal hydrocarbons under hydroprocessing conditions with a catalyst comprising delaminated SSZ-70. The delaminated SSZ-70 has been found to provide unexpected improvements in the catalysis of hydroprocessing hydrocarbons. Delaminated SSZ-70 offers a zeolite layer with a single unit cell of thickness in one dimension, allowing an elimination of mass transfer in comparison with non-delaminated SSZ-70.

13 Claims, 5 Drawing Sheets

Acidic sites
micro/meso-pore
(i)

Acidic sites
micro-pore only
(ii)

Acidic sites
meso-pore only
(iii)

(56) References Cited

U.S. PATENT DOCUMENTS

| | | | | |
|---|---|---|---|---|
| 5,316,753 | A | 5/1994 | Nakagawa | |
| 7,108,843 | B2 | 9/2006 | Zones et al. | |
| 7,550,073 | B2 * | 6/2009 | Zones | B01J 29/86 208/113 |
| 8,637,419 | B2 | 1/2014 | Zhan | |
| 2006/0138025 | A1 | 6/2006 | Zones et al. | |
| 2008/0314726 | A1 * | 12/2008 | Choros | C10B 53/00 202/105 |
| 2012/0148487 | A1 * | 6/2012 | Katz | C01B 39/026 423/718 |
| 2016/0115397 | A1 | 4/2016 | Zhan | |
| 2016/0122258 | A1 | 5/2016 | Zhan et al. | |
| 2016/0122260 | A1 | 5/2016 | Zhan et al. | |

OTHER PUBLICATIONS

International Search Report from PCT/US2015/056711 mailed Jan. 26, 2016.

Runnebaum, R.C., et al., "Role of Delamination in Zeolite-Catalyzed Aromatic Alkylation: UCB-3 versus 3-D Al-SSZ-70", ACS Catalysis, vol. 4, No. 7, pp. 2364-2368 (2014).

Corma, A. et al., "Delaminated zeolite precursors as selective acidic catalysts", Nature, vol. 396, Nov. 1998, pp. 353-356.

Ogino, et al., "Heteroatom-Tolerant Delamination of Layered Zeolite Precursor Materials", Chemistry of Materials, vol. 25, No. 9, pp. 1502-1509 (2013).

Archer, et al. "Physiochemical Properties and Catalytic Behavior of the Molecular Sieve SSZ-70", Chemistry of Materials, 2010, vol. 22, pp. 2563-2572.

* cited by examiner

HYDROPROCESSING OF HYDROCARBONS USING DELAMINATED ZEOLITE SUPPORTS AS CATALYSTS

CROSS REFERENCE TO RELATED APPLICATION

This application is a continuation-in-part of U.S. application Ser. No. 14/521,098, filed Oct. 22, 2014, entitled "Hydroprocessing of Hydrocarbons Using Delaminated Zeolite Supports as Catalysts", the contents of which are herein incorporated by reference in their entirety.

FIELD OF THE INVENTION

The present invention relates to delaminated zeolites and their use as catalysts in the hydroprocessing of hydrocarbons. More specifically, the present invention relates to a delaminated SSZ-70 material and the use of delaminated SSZ-70 as a catalyst in the hydroisomerization of hydrocarbons.

BACKGROUND

Zeolites are widely used as acidic catalysts for refining applications attributed to their unique and uniform pore structure with sizes in the sub-nanometer range. The pore sizes of zeolites dictate the reaction in refining processes including hydroisomerization, hydrocracking, olefin alkylation and olefin oligomerization, and thus dictate reaction selectivity. However, hydroprocessing products often experience varying degrees of continuous (over)cracking when they diffuse out of micrometer-scale zeolitic channels. Thus elimination of these types of side-reactions is significant for reaction efficiency and product quality improvement. One of the solutions for preventing overcracking is reduction of acidic strength. But this approach reduces the catalyst activity at the same time.

A. Corma et al. in "Delaminated zeolite precursors as selective acidic catalysts", *Nature*, vol. 396, November 1998, pp 353-356, discusses delaminating MCM-22(P), the precursor of both MCM-22 and ERB-1 zeolites. The delaminated zeolite is designated ITQ-2, and was shown to have catalytic potential.

Molecular sieve SSZ-70 is known and is discussed in "Physiochemical Properties and Catalytic Behavior of the Molecular Sieve SSZ-70", Archer et al. *Chemistry of Materials,* 2010, vol. 22, pp 2563-2572. A method for the synthesis of the SSZ-70 is discussed. Pure silica, borosilicate and aluminosilicate SSZ-70 materials were prepared and characterized. The catalytic activity of Al-SSZ-70 materials was tested using the CI (Constraint Index) test. U.S. Pat. Nos. 7,108,843 and 7,550,073 also discuss the synthesis of the molecular sieve SSZ-70, and its use in hydrocarbon conversion processes such as hydrocracking. The disclosure of both U.S. Pat. Nos. 7,108,843 and 7,550,073 are expressly incorporated herein by reference in their entirety.

SUMMARY

Provided is a process of hydroprocessing, and more particularly improved isomerizing, hydrocarbons in the presence of a delaminated SSZ-70 catalyst. The delaminated SSZ-70 has been found to provide unexpected improvements in the catalysis of hydroprocessing hydrocarbons. It has been found that delaminated SSZ-70 offers a zeolite layer with a single unit cell of thickness in one dimension, allowing an elimination of mass transfer in comparison with regular SSZ-70 (non-delaminated). For example, an unexpected and significant improvement of isomerization selectivity has been achieved when using a delaminated SSZ-70 compared to regular SSZ-70.

The delaminated SSZ-70 zeolite also exhibits features of maintaining zeolitic acidity strength and spatial constraint of internal zeolite framework. This provides opportunities to control novel chemistry by tailoring the location of acidic sites for desired chemical reactions.

BRIEF DESCRIPTION OF THE DRAWINGS

FIG. 2 illustrates that the catalyst containing delaminated Al-SSZ-70 is less active than the Al-SSZ-70 because of lowered Al Brönsted acidic sites.

FIG. 3 illustrates that the catalyst containing delaminated SSZ-70 significantly enhances the yield of C7+ products, indicating improved overcracking.

FIG. 4 illustrates that the catalyst containing delaminated Al-SSZ-70 significantly enhances the selectivity of isomerized $C_{16}$ product by nearly 20%.

FIG. 5 illustrates that the delaminated SSZ-70 inhibits further isomerization of methyl-pentadecane ($MeC_{15}$) isomers to dimethyl-tetradecane (Di-$MeC_{14}$) products.

DETAILED DESCRIPTION OF THE PREFERRED EMBODIMENTS

The present invention relates to an improved hydrocracking process which allows one to achieve superior isomer selectivity or isoselectivity hereafter. The process comprises contacting a hydrocarbon feed comprised of normal hydrocarbons under hydroprocessing conditions with a catalyst comprising delaminated SSZ-70. It has been found that delaminated SSZ-70 offers a zeolite layer with a single unit cell of thickness in one dimension, allowing an elimination of mass transfer in comparison with regular SSZ-70. The result is superior isoselectivity when used in a hydroprocessing process. It is important that the process involves hydrogen. Thermal cracking, for example, which would not involve hydrogen, would result in severe coking of the delaminated SSZ-70.

Figure 1:
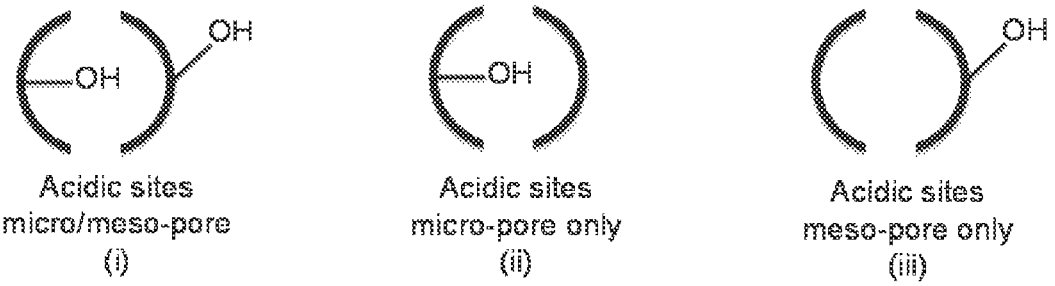
FIG. 1 depicts acidic sites distribution on delaminated SSZ-70. In one embodiment of this application, the delaminated SSZ-70 contains Brönsted acidity on the internal and external surface of the micropore.
Figure 2:
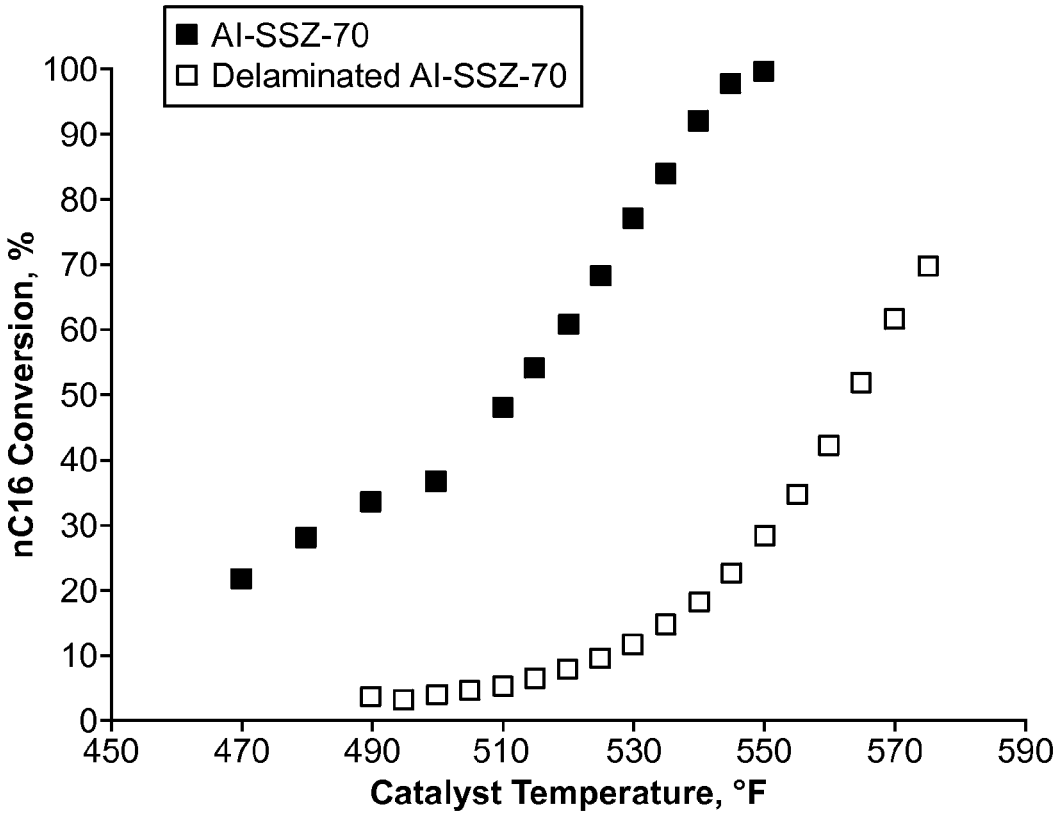
FIG. 2 graphically depicts $nC_{16}$ conversion with regard to reaction temperature for delaminated Al-SSZ-70 and Al-SSZ-70.

The delaminated SSZ-70 also exhibits features of maintaining zeolitic acidic strength and spatial constraint of the internal zeolitic framework. This provides one with the opportunity of controlling novel chemistry by tailoring the location of acidic sites. Turning to FIG. 1, three scenarios are schematically provided of the controlled location of acidic sites that can be prepared with starting materials of delaminated SSZ-70 in either the Al- or B-form. An $nC_{16}$ hydroprocessing was conducted over delaminated SSZ-70 with acid sites located both on the internal cages and external surfaces (e.g. schematic (i) in FIG. 1). The isoselectivity for delaminated SSZ-70 far exceeds that achieved with regular SSZ-70. Such selectivity offers an isomerization reaction with greater control of the product obtained, which would be of great benefit to the industry. One of the benefits is improved diesel cold flow property.

The molecular sieve SSZ-70 is known, as is the synthesis thereof. U.S. Pat. No. 7,108,843, issued Sep. 19, 2006, for example describes the molecular sieve SSZ-70 and a synthesis for preparing the molecular sieve. The SSZ-70 is characterized in U.S. Pat. No. 7,108,843 by its X-ray diffraction pattern before calcination, and by its X-ray diffraction pattern after calcination. The disclosure of U.S. Pat. No. 7,108,843 is hereby expressly incorporated by reference herein in its entirety.

The delaminated SSZ-70 can be obtained by delaminating the SSZ-70 molecular sieve using conventional techniques of delamination. In one embodiment, the techniques described in U.S. 2012/0148487, published Jun. 14, 2012, would be quite effective, which publication is expressly incorporated herein by reference in its entirety.

In general, an aqueous mixture of chloride and fluoride anions, e.g., alkylammoniumhalides and the SSZ-70 is prepared. The aqueous mixture is maintained at a pH less than 12, e.g., about 9, and maintained at a temperature in the range of 5-150° C. for a length of time sufficient to effect the desired delamination. The oxide product is then recovered, e.g., by acidification to a pH of about 2 followed by centrifugation.

In one embodiment, a non-aqueous mixture of chloride and fluoride anions, i.e., a mixture comprising an organic solvent, is maintained at a temperature in the range of from 5-150° C. to effect the desired delamination. The organic solvent can be any suitable organic solvent which swells the starting material such as dimethyl formamide (DMF). The delaminated product can then be recovered from the mixture. Generally, acidification is used to recover the product. Sonication prior to recovery need not be employed, but sonification can be employed in the process if desired.

The chloride and fluoride anions can be obtained from any source of the anions. Any compound which will provide the anions in aqueous solution can be used. The cation is generally not important. Providing the fluoride and chloride anions is important. Bromide anions can also be present, but both fluoride and chloride anions must be present. The cations can be any cation, with the use of alkylammonium cations being suitable in one embodiment. The alkyl group of such a cation can be any length, and in one embodiment ranges from 1-20 carbons. Tetrabutylammonium cations in particular have been found useful. The molar ratio of chloride to fluoride anions can be 100 or less, generally from 100:1 to 1:100. In one embodiment, the ratio can range from 50:1 to 1:50. It is the combination of the fluoride and chloride anions which has been discovered to be important.

The pH used in the synthesis when an aqueous mixture is used is lower than that generally used in delamination synthesis. The pH is generally 12 or less, but can be any pH which does not transform the silica in the zeolite to create an amorphous silica phase. A pH of 12 or less generally accomplishes this task and thereby allows one to obtain a delaminated layered zeolite precursor material substantially without an amorphous phase. In another embodiment, the pH is 11 or less, and even 10 or less, with a pH of about 9 or less also being quite advantageous. A pH of approximately 9 is typically used in fluoride-mediated synthesis of zeolites.

The temperature used in the process for either the aqueous or non-aqueous mixture can range widely. In general a temperature for the aqueous solution of from 5-150° C. is suitable. In another embodiment, the temperature can range from 50-100° C.

The length of time the zeolite is allowed to swell, and delaminate, in the aqueous solution can vary greatly. Generally, the time can vary from 30 minutes to one month. In one embodiment, the time ranges from 2 hours to 50 hours. In another embodiment, the time can range from 5 to 20 hours prior to collection of the product.

The delaminated oxide product is collected using conventional techniques such as centrifugation. An acid treatment step can be employed prior to centrifugation, and may be conveniently conducted by contacting the swollen or partially delaminated layered zeolite precursor material with a strong acid, e.g., a mineral acid such as hydrochloric acid or nitric acid, at low pH, e.g., pH 2. Collection of the resulting oxide material product can be performed by centrifugation.

The present process comprises contacting the hydroprocessing catalyst, i.e., a catalyst comprising delaminated SSZ-70, with a hydrocarbon feed under hydrocracking conditions. The catalyst can comprise pure delaminated SSZ-70 or in mixture with any suitable conventional catalyst, and can be present in the catalyst in amounts as small as 2 parts by weight. Generally the catalyst will comprise at least 2 parts by weight of the delaminated SSZ-70. In one embodiment, the hydrocarbon feed for the process comprises a substantial amount of $C_4$ to $C_{20}$ normal hydrocarbons. Slightly branched hydrocarbons can also be in the feed. In one embodiment, the hydrocarbon feed is a hydrotreated VGO.

The hydroprocessing reaction is carried out in the presence of hydrogen. Preferably, hydrogen is added to give a hydrogen to hydrocarbon ratio ($H_2$/HC) of between about 500 and about 30,000 SCF/bbl (standard cubic feet per barrel) (0.089 to 5.34 SCM/liter (standard cubic meters/liter)), preferably about 3,000 to about 10,000 SCF/bbl (0.534 to 1.78 SCM/liter). See U.S. Pat. No. 8,637,419 and U.S. Pat. No. 5,316,753 for a further discussion of hydroprocessing process conditions, which patents are expressly incorporated by reference herein in their entirety.

The delaminated SSZ-70 catalyst preferably contains one or more metals. For each embodiment described herein, each metal employed is selected from the group consisting of elements from Group VI and Groups VIII through X of the Periodic Table, and mixtures thereof. In one sub-embodiment, each metal is selected from the group consisting of nickel (Ni), palladium (Pd), platinum (Pt), cobalt (Co), iron (Fe), chromium (Cr), molybdenum (Mo), tungsten (W), and mixtures thereof. In another sub-embodient, the delaminated SSZ-70 catalyst contains at least one Group VI metal and at least one metal selected from Groups VIII through X of the Periodic table. Exemplary metal combinations include Ni/Mo/W, Ni/Mo, Ni/W, Co/Mo, Co/W, Co/W/Mo and Ni/Co/W/Mo. Modifying agents can be added to the metal-containing solution before impregnation. See U.S. Pat. No. 8,637,419 for a further discussion of hydroprocessing catalyst preparation conditions with modifying agents, which patent is expressly incorporated by reference herein in their entirety.

In one embodiment, the delaminated SSZ-70 catalyst contains a Group VIII metal compound. By Group VIII metal compound, as used herein, is meant the metal itself or a compound thereof. The Group VIII noble metals and their compounds, platinum, palladium, and iridium, or combinations thereof can be used. Rhenium and tin may also be used in conjunction with the noble metal. The most preferred metal is platinum. The amount of Group VIII metal present in the conversion catalyst should be within the normal range of use in hydroprocessing catalysts, from about 0.05 to 2.0 weight percent, preferably 0.2 to 0.8 weight percent.

Due to the isomerization characteristics of the delaminated SSZ-70, the catalyst is quite useful in an isomerization/dewaxing process. The catalyst can be used to dewax hydrocarbonaceous feeds by selectively isomerizing straight chain paraffins. Typically, the viscosity index of the dewaxed product is improved (compared to the waxy feed) when the waxy feed is contacted with the delaminated SSZ-70 under isomerization dewaxing conditions.

The catalytic isomerization dewaxing conditions are dependent in large measure on the feed used and upon the desired pour point. Hydrogen is preferably present in the reaction zone during the catalytic isomerization dewaxing process. The hydrogen feed ratio is typically between about 500 and about 30,000 SCF/bbl (standard cubic feet per barrel) (0.089 to 5.34 SCM/liter (standard cubic meters/liter)), preferably about 1000 to about 20,000 SCF/bbl (0.178 to 3.56 SCM/liter). Generally, hydrogen will be separated from the product and recycled to the reaction zone. Typical feedstocks include light gas oil, heavy gas oils and reduced crudes boiling above about 350° F. (177° C.).

A typical isomerization dewaxing process can comprise the catalytic dewaxing of a hydrocarbon oil feedstock boiling above about 350° F. (177° C.) containing straight chain and slightly branched chain hydrocarbons by contacting the hydrocarbon oil feedstock in the presence of added hydrogen gas at a hydrogen pressure of about 15-3000 psi (0.103-20.7 Mpa) with a catalyst comprising delaminated SSZ-70 and at least one Group VIII metal.

The delaminated SSZ-70 catalyst may optionally contain a hydrogenation component of the type commonly employed in dewaxing catalysts. See, for example, U.S. Pat. No. 5,316,753 for examples of these hydrogenation components. The hydrogenation component is present in an effective amount to provide an effective hydrodewaxing and hydroisomerization catalyst preferably in the range of from about 0.05 to 5% by weight. The catalyst may be run in such a mode to increase isomerization dewaxing at the expense of cracking reactions.

The feed may be hydrocracked, followed by isomerization dewaxing. This type of two stage process and typical hydrocracking conditions are described in U.S. Pat. No. 4,921,594 issued May 1, 1990 to Miller, which is incorporated herein by reference in its entirety.

The following examples are provided to further illustrate the present invention, and are not meant to be limiting.

EXAMPLE 1

Preparation of Al-SSZ-70

7.67 g aluminum hydroxide (Reheis F-2000) was added to 395.55 g NaOH (1M) in a 1 gallon liner. 240 g Cabosil fumed silica was slowly added while stirring. At the same time, 1707.47 g 1,3-diisobutylimidazolium hydroxide (9 wt %, SDAOH-1) and 149.27 g deionized water was added to the liner. The final molar composition was 1 $SiO_2$:0.01 $Al_2O_3$:0.2 SDAOH-1:0.1 NaOH:30$H_2O$. The liner was placed into a 1 gallon, overhead stirred autoclave. The temperature was increased to 160° C. with a ramp time of 8 h and a stir rate of 150 rpm. The reaction mixture was synthesized for 120 h. The final solids were filtered and washed with deionized water to a conductivity of <50 μS/cm.

Preparation of B-SSZ-70

2.91 g $H_3BO_3$ was added to 84.20 g NaOH (1M) in a 1 L Teflon liner. 50.52 g of Cabosil fumed silica was slowly added while stirring. At the same time, 413.6 g 1,3-Bis (cyclohexyl)imidazolium hydroxide (0.40 M, SDAOH-2) was added to the liner. The final molar composition was 1 $SiO_2$:0.03 $B_2O_3$:0.2 SDAOH-2:0.1 NaOH:30$H_2O$. The liner was placed into a 1 L, overhead stirred, Parr autoclave. The temperature was increased to 160° C. with a ramp time of 8 h and a stir rate of 70 rpm. The reaction mixture was synthesized for 116 h. The final solids were filtered and washed with deionized water to a conductivity of 26 μS/cm.

Preparation of Delaminated B-SSZ-70

5 g of as-made B-SSZ-70 was added to a 500 mL, 1-neck, round-bottom flask. 200 mL N,N-dimethylformamide, 5.5 g cetyltrimethylammonium bromide, 8.5 g tetrabutylammonium fluoride trihydrate, and 8.5 g tetrabutylammonium chloride were added to the flask. The contents of the flask were stirred in a 95° C. oil bath for 48 h. The contents of the flask were then poured into a 500 mL wide-mouth bottle and sonicated in an ice bath for 2 h using a sonicator made by Sonics and Materials Inc. (Vibracell VC 750, 35% power) operating under pulse mode (4 s on and 1 s off). The delaminated solution was divided into four equal parts and poured into four 250 mL centrifuge bottles. 200 mL tetrahydrofuran was added to each centrifuge bottle, and the bottles were centrifuged at 8500 rpm (11000 g) for 10 min. The solution was decanted, 250 mL fresh THF was added to each bottle, and the solids were redispersed into the solution. The bottles were centrifuged and decanted. 250 mL diethyl ether was added to each bottle and the solids were redispersed into the solution. The bottles were centrifuged, decanted, and the solids were dried at 80° C. The sample was calcined at 550° C. for six hours at a ramp rate of 1° C./min in flowing air.

Preparation of Al—Exchanged Delaminated Al-SSZ-70

3 g of delaminated B-SSZ-70 was added to a 250 mL, 1-neck, round-bottom flask. 75 g deionized water and 11.25 g aluminum nitrate nonahydrate were added to the flask. The contents of the flask were stirred in a 95° C. oil bath for 96 h. The mixture was filtered and washed with 300 mL HCl (pH=2). The mixture was filtered and washed with another 300 mL HCl. The mixture was filtered and washed with deionized water to a pH of 7. The solids were dried at 80° C.

Preparation of a catalyst base containing 10% Al-SSZ-70 (catalyst base-A, base case)

A comparative catalyst was prepared per the following procedure: 90 parts by weight pseudo boehmite alumina powder (obtained from Sasol), and 10 parts by weight of Al-SSZ-70 zeolite were mixed well. The SSZ-70 zeolite employed had the following properties: a $SiO_2/Al_2O_3$ mole ratio of about 80. A diluted $HNO_3$ acid aqueous solution (1 wt. %) was added to the mix powder to form an extrudable paste. The paste was extruded in 1/16 inch asymmetric quadrilobe shape, and dried at 250° F. (121° C.) overnight. The dried extrudates were calcined at 850° F. (454° C.) for 1 hour with purging excess dry air and cooled down to room temperature.

Preparation of 0.5 wt % Pt catalyst Containing 10% Al-SSZ-70 (Catalyst-A, Base Case)

Impregnation of Pt metal was done using an aqueous solution containing 3.3% Pt salt in concentrations equal to the target metal loadings of 0.5 wt. % Pt based on the bulk dry weight of the finished catalyst. The total volume of the solution matched the 103% water pore volume of the above calcined base extrudate sample (incipient wetness method). The metal solution was added to the base extrudates of base-A (base case) gradually while tumbling the extrudates. When the solution addition was completed, the soaked extrudates were aged for 2 hours. Then the extrudates were dried at 250° F. (121° C.) overnight. The dried extrudates were calcined at 662° F. (350° C.) for 1 hour with purging excess dry air, and cooled down to room temperature. The performance of this catalyst was evaluated with nC 16 pure compound.

Preparation of a New Catalyst Base Containing 10% Delaminated Al-SSZ-70 (Catalyst Base-B)

A new isomerization-improved catalyst base was prepared per the following procedure: 90 parts by weight pseudo boehmite alumina powder (obtained from Sasol), and 10 parts by weight of delaminated Al-SSZ-70 zeolite were mixed well. A diluted $HNO_3$ acid aqueous solution (1 wt. %) was added to the mix powder to form an extrudable paste. The paste was extruded in 1/16 inch asymmetric quadrilobe shape, and dried at 250° F. (121° C.) overnight. The dried extrudates were calcined at 850° F. (454° C.) for 1 hour with purging excess dry air and cooled down to room temperature.

Preparation of 0.5 wt % Pt Catalyst Containing 10% Delaminated Al-SSZ-70 (Catalyst-B)

Impregnation of Pt was done using an aqueous solution containing 3.3 wt. % Pt salt in concentrations equal to the target metal loadings of 0.5 wt. % Pt based on the bulk dry weight of the finished catalyst. The total volume of the solution matched the 103% water pore volume of the above calcined base extrudate sample (incipient wetness method). The metal solution was added to the base extrudates of base-B gradually while tumbling the extrudates. When the solution addition was completed, the soaked extrudates were aged for 2 hours. Then the extrudates were dried at 250° F. (121° C.) overnight. The dried extrudates were calcined at 662° F. (350° C.) for 1 hour with purging excess dry air, and cooled down to room temperature. The performance of this catalyst was evaluated with nC 16 pure compound.

Preparation of a Catalyst New Base Containing 2% Delaminated Al-SSZ-70 (Catalyst Base-C)

A new isomerization-improved catalyst base was prepared per the following procedure: 25 parts by weight pseudo boehmite alumina powder (obtained from Sasol), 73 parts by weight of silica-alumina powder (obtained from Sasol), and 2 parts by weight of delaminated Al-SSZ-70 zeolite were mixed well. A diluted $HNO_3$ acid aqueous solution (1 wt. %) was added to the mix powder to form an extrudable paste. The paste was extruded in 1/16 inch asymmetric quadrilobe shape, and dried at 250° F. (121° C.) overnight. The dried extrudates were calcined at 850° F. (454° C.) for 1 hour with purging excess dry air and cooled down to room temperature.

Preparation of 0.5 wt % Pt Catalyst Containing 2% Delaminated Al-SSZ-70 (Catalyst-C)

Impregnation of Pt was done using an aqueous solution containing 3.3 wt. % Pt salt in concentrations equal to the target metal loadings of 0.5 wt. % Pt based on the bulk dry weight of the finished catalyst. The total volume of the solution matched the 103% water pore volume of the above calcined base extrudate sample (incipient wetness method). The metal solution was added to the base extrudates of base-C gradually while tumbling the extrudates. When the solution addition was completed, the soaked extrudates were aged for 2 hours. Then the extrudates were dried at 250° F. (121° C.) overnight. The dried extrudates were calcined at 662° F. (350° C.) for 1 hour with purging excess dry air, and cooled down to room temperature. The performance of this catalyst was evaluated with nC 16 pure compound.

Preparation of a New Catalyst Base Containing 3% Delaminated B-SSZ-70 (Catalyst Base-D)

A new isomerization-improved catalyst base was prepared per the following procedure: 25 parts by weight pseudo boehmite alumina powder (obtained from Sasol), 72 parts by weight of silica-alumina powder (obtained from Sasol), and 3 parts by weight of delaminated B-SSZ-70 zeolite were mixed well. A diluted $HNO_3$ acid aqueous solution (1 wt. %) was added to the mix powder to form an extrudable paste. The paste was extruded in 1/16 inch asymmetric quadrilobe shape, and dried at 250° F. (121° C.) overnight. The dried extrudates were calcined at 850° F. (454° C.) for 1 hour with purging excess dry air and cooled down to room temperature.

Preparation of 0.5 wt % Pt Catalyst Containing 3% Delaminated B-SSZ-70 (Catalyst-D)

Impregnation of Pt was done using an aqueous solution containing 3.3 wt. % Pt salt in concentrations equal to the target metal loadings of 0.5 wt. % Pt based on the bulk dry weight of the finished catalyst. The total volume of the solution matched the 103% water pore volume of the above calcined base extrudate of base-D (incipient wetness method). The metal solution was added to the base extrudates gradually while tumbling the extrudates. When the solution addition was completed, the soaked extrudates were aged for 2 hours. Then the extrudates were dried at 250° F. (121° C.) overnight. The dried extrudates were calcined at 662° F. (350° C.) for 1 hour with purging excess dry air, and cooled down to room temperature.

All the catalysts and their supports were characterized as follows:

Brönsted acidity: determined by isopropylamine-temperature-programmed desorption (IPam TPD) adapted from the published descriptions by T. J. Gricus Kofke, R. K. Gorte, W. E. Farneth, J. Catal. 114, 34-45, 1988; T. J. Gricus Kifke, R. J. Gorte, G. T. Kokotailo, J. Catal. 115, 265-272, 1989; J. G. Tittensor, R. J. Gorte and D. M. Chapman, J. Catal. 138, 714-720, 1992. Samples are pre-treated at 400-500° C. for 1 hour in flowing dry $H_2$. The dehydrated samples are then cooled down to 120° C. in flowing dry He and held at 120° C. for 30 minutes in a flowing He saturated with isopropylamine for adsorption. The isopropylamine-saturated samples are then heated up to 500° C. at a rate of 10° C./min in flowing dry He. The Brönsted acidity is calculated based on the weight loss vs. temperature by TGA and effluent $NH_3$ and propene by Mass Spectrometer.

Surface area: determined by $N_2$ adsorption at its boiling temperature. BET surface area is calculated by the 5-point method at $P/P_0$=0.050, 0.088, 0.125, 0.163, and 0.200. Samples are first pre-treated at 400° C. for 6 hours in the presence of flowing, dry $N_2$ so as to eliminate any adsorbed volatiles like water or organics.

TABLE 1

Properties of calcined catalyst bases containing Al-SSZ-70 and delaminated Al-SSZ-70

| Catalyst base | Zeolite | Micropore volume, cc/g | Ext. SA, m2/g | Brönsted acidity, μmol/g |
|---|---|---|---|---|
| Base-A (base case) | Original SSZ-70 (w/o delaminated) | 0.0214 | 207 | 161 |
| Base-B | Delaminated SSZ-70 | 0.0068 | 277 | 131 |

The high external surface area of the support of the new catalyst base-B in comparison with the base case catalyst support of catalyst base-A is contributed to the high external surface area of delaminated Al-SSZ-70. In contrast to the base case catalyst base-A, the delaminated SSZ-70-containing catalyst base-B showed a lower micropore volume. Delaminated SSZ-70 showed less Brönsted acidic density than its original precursor.

TABLE 2

Properties of calcined catalyst bases containing delaminated Al-SSZ-70 and delaminated B-SSZ-70

| Catalyst base | Zeolite | Surface Area, m2/g | Pore volume, cm3/g | Mesopore size, nm | Brönsted acidity, μmol/g |
|---|---|---|---|---|---|
| Base-C | 2% Delaminated Al-SSZ-70 | 421 | 0.81 | 11.3 | 142 |
| Base-D | 3% Delaminated B-SSZ-70 | 420 | 0.80 | 11.2 | 158 |

The high Brönsted acidity of the catalyst base-D suggests Al exchanged to the B site of zeolite framework during the extrusion process. Thus it is concluded that the Al exchange process can be eliminated in the preparation of hydroprocessing catalysts using delaminated B-SSZ-70 zeolite.

$nC_{16}$ Test

Figure 3:
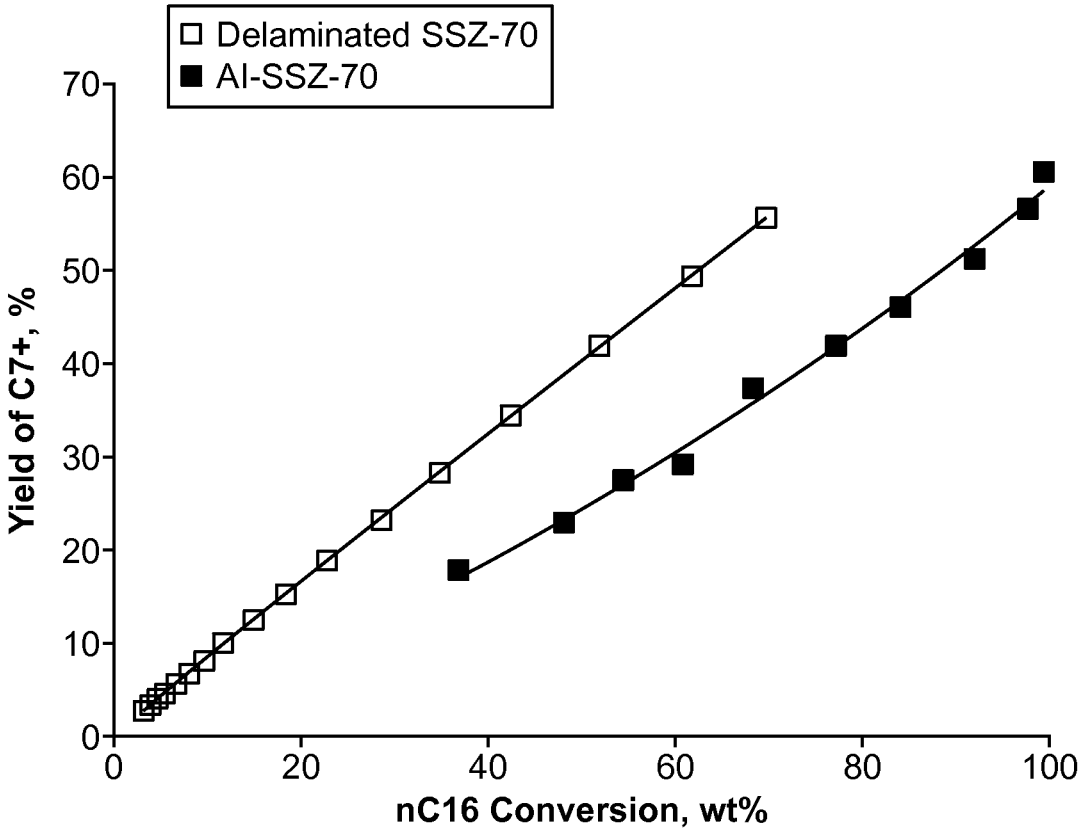
FIG. 3 graphically depicts C7+ product yield for $nC_{16}$ conversion when using delaminated SSZ-70 and Al-SSZ-70.
Figure 4:
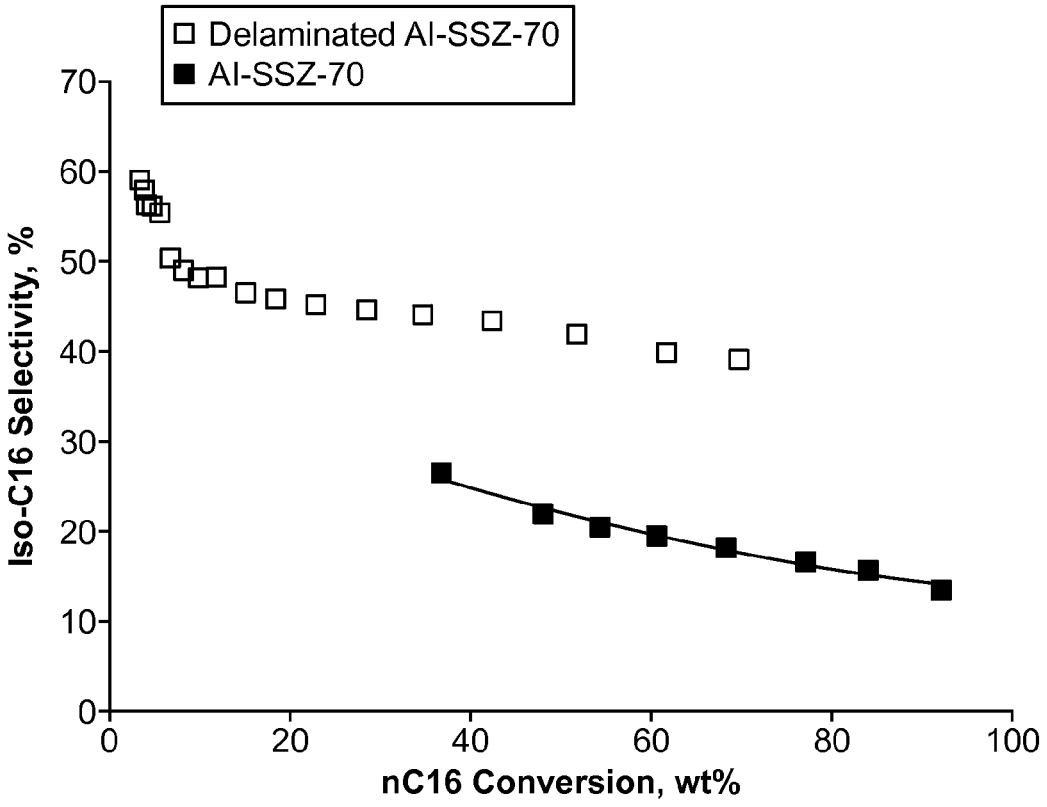
FIG. 4 graphically depicts the significant improvement of hydroisomerization selectivity when using delaminated Al-SSZ-70.
Figure 5:
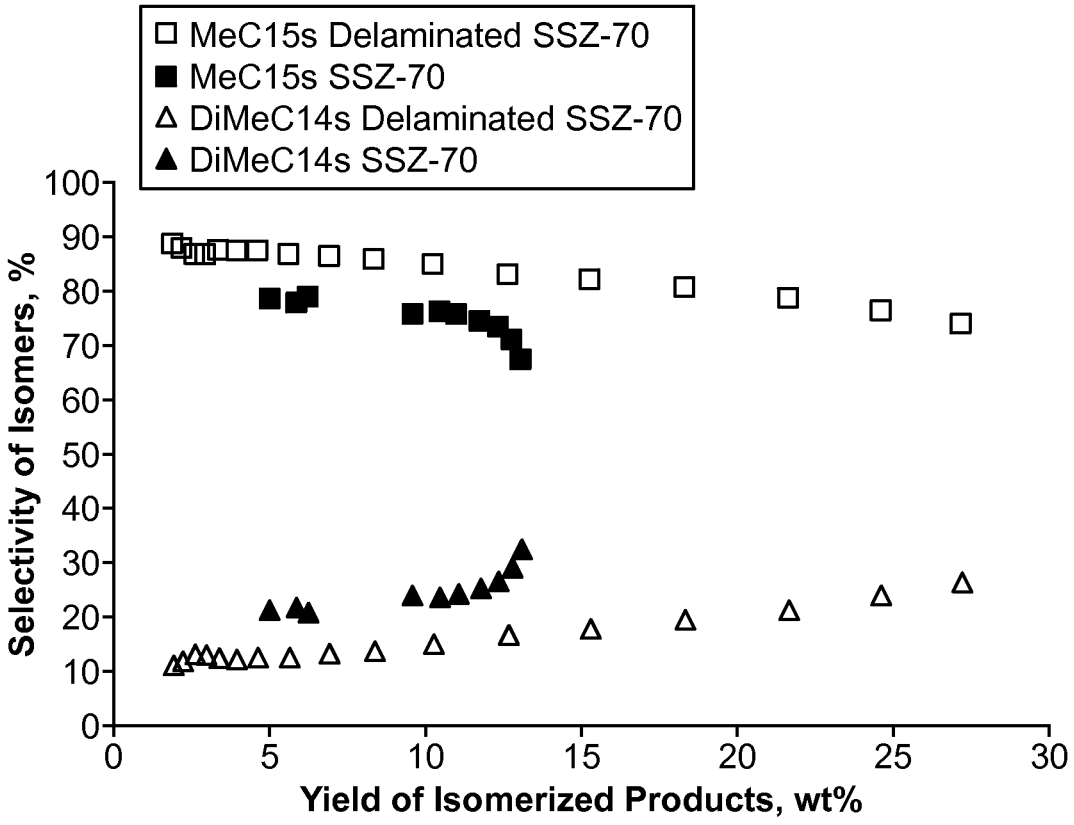
FIG. 5 graphically depicts the selectivity of $C_{16}$ isomers for delaminated SSZ-70.

An $nC_{16}$ pure compound feed was used to evaluate the hydroprocessing performances of the catalysts. In each test, the catalyst was subjected to the following process conditions: 0.5 gram catalyst (crushed to 24-42 mesh), 1200 PSIG total inlet pressure, 160 ml/min $H_2$ rate and 1.0 ml/hr feed rate. The various tests and their results are shown in FIGS. 2-5. In FIGS. 2 to 5, the overall conversion is shown as measured. The catalyst-B containing 10% delaminated SSZ-70 was shown to be less active than the catalyst-A containing 10% Al-SSZ-70. This is thought to be because of lowered Brönsted acidic sites. In FIG. 3, the catalyst-B containing 10% delaminated SSZ-70 significantly increased the yield of C7+. In FIGS. 4 and 5, it can be seen that the delaminated SSZ-70 significantly enhances the selectivity of isomerized C16 products, by nearly 20%, while also further inhibiting isomerization of $MeC_{15}$ isomers to $DiMeC_{14}$ products. This demonstrates the superior isoselectivity of the delaminated SSZ-70 catalyst. By using a delaminated SSZ-70 based catalyst in a hydroprocessing process, one can realize an isoselectivity of at least 40 wt % for $nC_{16}$ conversion, and in one embodiment, an isoselectivity of at least 50 wt % for $nC_{16}$ conversion. The $nC_{16}$ testing results also indicated catalysts C and D have very comparable isoselectivity.

EXAMPLE 2

Preparation of NiW-Based Hydroprocessing Catalyst Containing USY Zeolite

A NiW-based hydroprocessing catalyst containing USY zeolite as a base case catalyst for VGO hydroprocessing was prepared per the following procedure: 67 parts by weight silica-alumina powder (obtained from Sasol), 25 parts by weight pseudo boehmite alumina powder (obtained from Sasol), and 8 parts by weight of zeolite Y (from Tosoh) were mixed well. A diluted $HNO_3$ acid aqueous solution (1 wt. %) was added to the mix powder to form an extrudable paste. The paste was extruded in 1/16" asymmetric quadrilobe shape, and dried at 250° F. (121° C.) overnight. The dried extrudates were calcined at 1100° F. (593° C.) for 1 hour with purging excess dry air, and cooled down to room temperature.

Impregnation of Ni and W was done using a solution containing tungsten and nickel metal salts in concentrations equal to the target metal loadings of 4 wt. % NiO and 28 wt. % $WO_3$ based on the bulk dry weight of the finished catalyst. Organic citric acid, in an amount equal to 10 wt. % of the bulk dry weight of the finished catalyst, was added to the Ni/W solution. See U.S. Pat. No. 8,637,419 for a further discussion of hydroprocessing catalyst preparation conditions with modifying agents, which patent is expressly incorporated by reference herein in their entirety. The solution was heated to above 120° F. (49° C.) to ensure a completed dissolved (clear) solution. The total volume of the metal solution matched the 103% water pore volume of the base extrudates (incipient wetness method). The metal solution was added to the base extrudates gradually while tumbling the extrudates. When the solution addition was completed, the soaked extrudates were aged for 2 hours. Then the extrudates were dried at 400° F. (205° C.) for 2 hour with purging excess dry air, and cooled down to room temperature.

Preparation of NiW-Based Hydroprocessing Catalyst Containing 2% Delaminated Al-SSZ-70 (New Catalyst-E)

Impregnation of Ni and W was prepared in the same way as described above for the hydroprocessing catalyst containing USY zeolite. The impregnation was done using a solution containing tungsten and nickel metal salts in concentrations equal to the target metal loadings of 4 wt. % NiO and 28 wt. % $WO_3$ based on the bulk dry weight of the finished catalyst. Citric acid, in an amount equal to 10 wt. % of the bulk dry weight of the finished catalyst, was added to the Ni/W solution. See U.S. Pat. No. 8,637,419 for a further discussion of hydroprocessing catalyst preparation conditions with modifying agents, which patent is expressly incorporated by reference herein in their entirety. The solution was heated to above 120° F. (49° C.) to ensure a completed dissolved (clear) solution. The total volume of the metal solution matched the 103% water pore volume of the extrudates of catalyst base-C (incipient wetness method). The metal solution was added to the base extrudates gradually while tumbling the extrudates. When the solution addition was completed, the soaked extrudates were aged for 2 hours. Then the extrudates were dried at 400° F. (205° C.) for 2 hour with purging excess dry air, and cooled down to room temperature.

The benefits of using delaminated SSZ-70 for hydroprocessing a VGO feed are demonstrated. The VGO feed used is characterized in Table 3.

TABLE 3

VGO feed for hydroprocessing test

| | VGO Feed |
|---|---|
| API Gravity | 33.4 |
| Sulfur, ppm wt. | 14.3 |
| Nitrogen, ppm wt. | 0.5 |
| Oxygen, wt. % | 0 |
| PCI | 333 |
| Components | |
| Paraffins, LV % | 25.5 |
| Naphthenes, LV % | 66.5 |
| Aromatics, LV % | 8.0 |

TABLE 3-continued

| VGO feed for hydroprocessing test | |
|---|---|
| | VGO Feed |
| ASTM D2887 SimDis, -° F.(° C.) | |
| 0.5 wt. %/5 wt. % | 771/819 (381/437) |
| 10 wt. %/30 wt. % | 840/886 (449/474) |
| 50 wt. % | 925 (496) |
| 70 wt. %/90 wt. % | 970/1045 (521/563) |
| 95 wt. %/99.5 wt. % | 1087/1213 (586/656) |

In the process run, the hydroprocessing process conditions were 1900 psia hydrogen partial pressure, 1.5 LHSV, 5000 SCF/B hydrogen oil ratio, ~60 wt % per pass hydrocracking conversion to less than 700° F. product. The resulting products, when a typical USY zeolite catalyst is used as compared to a NiW catalyst based on a delaminated SSZ-70 (new catalyst—E), are characterized in Table 4.

TABLE 4

| Product properties of hydroprocessed VGO | | |
|---|---|---|
| Catalyst ID | NiW-based hydroprocessing catalyst containing De-SSZ-70 (new catalyst-E) | NiW-based hydroprocessing catalyst containing USY zeolite |
| Property of Diesel Product | | |
| API | 43.0 | 44.4 |
| ASTM D2887 SimDis, -° F.(° C.) | | |
| 0.5 wt. %/5 wt. % | 246/306 (119/152) | 245/303 (118/151) |
| 10 wt. %/30 wt. % | 343/440 (173/226) | 335/421 (168/216) |
| 50 wt. % | 526 (274) | 498 (259) |
| 70 wt. %/90 wt. % | 603/675 (317/357) | 578/662 (303/350) |
| 95 wt. %/99.5 wt. % | 693/722 (367/383) | 684/716 (362/380) |
| Cloud Point, ° C. | −36 | −26 |
| Pour Point, ° C. | −58 | −57 |
| Property of Unconverted Oil | | |
| API | 36.5 | 37.4 |
| Simdist, ° F./wt % | | |
| 0.5 wt. %/5 wt. % | 625/696 (329/369) | 632/698 (333/370) |
| 10 wt. %/30 wt. % | 715/767 (379/408) | 717/771 (381/411) |
| 50 wt. % | 812 (433) | 817 (436) |
| 70 wt. %/90 wt. % | 857/916 (458/491) | 860/918 (460/492) |
| 95 wt. %/99.5 wt. % | 943/1017 (506/547) | 945/1013 (507/545) |
| Cloud Point, ° C. | 22 | >42 |
| Pour Point, ° C. | 19 | 32 |

Results in Table 4 show that delaminated SSZ-70 improves cloud point and pour point more than 10° C. for diesel and unconverted oil products in comparison with the catalyst containing USY zeolite because of its enhanced isomerization activity.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. An isomerizing process comprising contacting a feed comprising $nC_{16}$ hydrocarbons under isomerization conditions with a catalyst comprising delaminated SSZ-70 and realizing an isoselectivity of at least 40 wt % for $nC_{16}$ conversion.

2. The process of claim 1, wherein the catalyst further comprises at least one metal selected from the group consisting of nickel (Ni), palladium (Pd), platinum (Pt), cobalt (Co), iron (Fe), chromium (Cr), molybdenum (Mo), tungsten (W), and mixtures thereof.

3. The process of claim 1, wherein the delaminated SSZ-70 is a delaminated Al-SSZ-70 zeolite.

4. The process of claim 1, wherein the delaminated SSZ-70 is a delaminated B-SSZ-70 zeolite.

5. The process of claim 1, wherein the feed comprises linear paraffins, FT-derived hydrocarbons, vacuum gas oil or mixtures thereof.

6. The process of claim 1, wherein the process realizes an isoselectivity of at least 50 wt % for $nC_{16}$ conversion.

7. The process of claim 1, wherein a yield of isomerized $C_{16}$ products from $nC_{16}$ hydrocarbons is at least 25 wt %.

8. The process of claim 1, wherein the delaminated SSZ-70 is prepared by a process comprising:

a) preparing a mixture comprising chloride and fluoride anions and an SSZ-70 zeolite;

b) maintaining the mixture at a pH of 12 or less at a temperature in the range of 5-150° C. for a length of time sufficient to effect the desired delamination; and c) recovering the delaminated SSZ-70 zeolite.

9. The process of claim 8, wherein the pH is about 9 or less.

10. The process of claim 8, wherein the mixture comprises a mixture of an alkylammonium chloride and an alkylammonium fluoride.

11. The process of claim 10, wherein the mixture further comprises an alkylammonium bromide.

12. The process of claim 10, wherein DMF is used in preparing the mixture.

13. The process of claim 1, wherein the delaminated SSZ-70 catalyst comprises a metal from Group VI and a metal from Group VIII.

* * * * *